United States Patent [19]

Reinehr et al.

[11] Patent Number: 5,028,369

[45] Date of Patent: Jul. 2, 1991

[54] PROCESS FOR THE PRODUCTION OF HYDROPHILIC ACRYLIC FIBERS

[75] Inventors: Ulrich Reinehr; Günter Türck; Egon Künzel; Dieter Paulini, all of Dormagen; Dieter Heinkes, Brueggen, all of Fed. Rep. of Germany

[73] Assignee: Bayer Aktiengesellschaft, Leverkusen, Fed. Rep. of Germany

[21] Appl. No.: 409,698

[22] Filed: Sep. 20, 1989

[30] Foreign Application Priority Data

Sep. 28, 1988 [DE] Fed. Rep. of Germany ..... 3832873

[51] Int. Cl.[5] ..... D01F 6/18; D01D 5/04

[52] U.S. Cl. ..... 264/103; 264/130; 264/148; 264/151; 264/168; 264/206; 264/210.7; 264/210.8; 264/211.15; 264/211.16; 264/211.17; 264/233

[58] Field of Search ..... 264/103, 168, 206, 130, 264/210.8, 148, 151, 211.15, 211.16, 211.17, 233

[56] References Cited

U.S. PATENT DOCUMENTS 4,336,214 6/1982 Reinehr et al. ..... 264/206
4,622,195 11/1986 Bueb et al. ..... 264/168

FOREIGN PATENT DOCUMENTS 2554124 6/1977 Fed. Rep. of Germany .

*Primary Examiner*—Hubert C. Lorin
*Attorney, Agent, or Firm*—Connolly & Hutz

[57] ABSTRACT

A process for the discontinuous or (preferably) continuous production of dry spun hydrophilic acrylic fibers and threads with a core/sheath structure which have improved color fastness properties, more uniform cross-sections and better processing characteristics. By employing a new after-treatment combination of more intensive counterflow washing, stretching in steam, fixing in steam and careful drying of the fibers as staple fibers, improved hydrophilic fibers with a water retention capacity above 30% can be obtained from spinning solutions which have a much lower non-solvent content than is necessary in the present-state of the art for obtaining a high water retention capacity of the order indicated above.

7 Claims, 2 Drawing Sheets

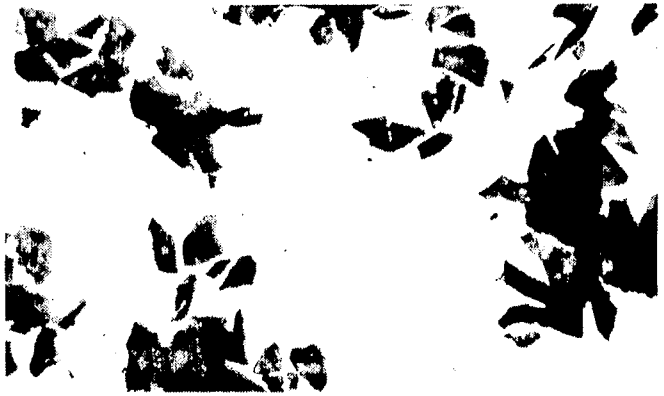
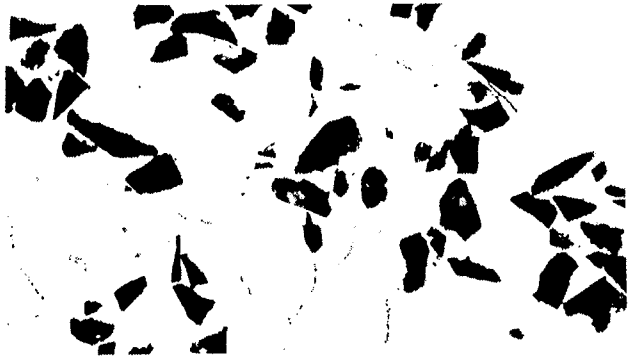

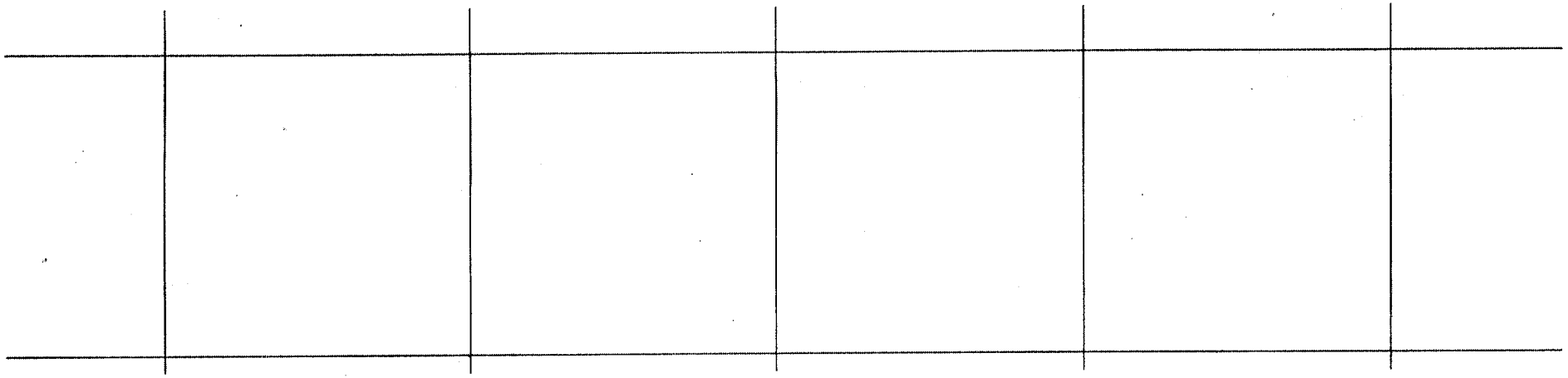

PROCESS FOR THE PRODUCTION OF HYDROPHILIC ACRYLIC FIBERS

This invention relates to a process for the discontinuous or (preferably) continuous production of dry spun hydrophilic acrylic fibers and threads with a core/-sheath structure which have improved colour fastness properties, more uniform cross-sections and better processing characteristics. By employing a new after-treatment combination of more intensive counterflow washing, stretching in steam, fixing in steam and careful drying of the fibres as staple fibers improved hydrophilic fibers with a water retention capacity above 30% can be obtained from spinning solutions which have a substantially lower nonsolvent content than is necessary in the present state of the art for obtaining high water retention capacities of the order indicated above.

BACKGROUND OF THE INVENTION

Hydrophilic acrylic fibers having a water retention capacity of at least 10% are obtained according to DE-PS 2 554 124 by adding to the spinning solvent (dimethylformamide) from 10 to 50% by weight, based on the solvent and solids content, of a liquid (preferably glycerol or tetraethyleneglycol) which boils at a temperature higher by 50° C. or more than the boiling point of the spinning solvent and is readily miscible with the spinning solvent and water and a non-solvent for the polymer, and spinning the resulting spinning solution at relatively low spinning shaft temperatures which are 5° to 30° C. above the boiling point of dimethylformamide.

The non-solvents used for polyacrylonitrile are preferably polyhydric alcohols or mono-or polysubstituted alkyl ethers or esters of polyhydric alcohols such as diethylene glycol, triethylene glycol, tetraethylene glycol or high boiling alcohols such as glycerol.

The solvent used for polyacrylonitrile is preferably dimethylformamide (DMF) but dimethylacetamide may also be used.

The acrylic fibers should contain ≧85% by weight of acrylonitrile, preferably ≧92% by weight of acrylonitrile in the acrylonitrile (co)polymer. For textile uses, the copolymer content has a value below 15% by weight, down to about 2% by weight, in particular from 8 to 3% by weight.

A water retention capacity of about 35% (30 to 40%) has been found optimal for ensuring good wearing comfort of textiles produced from such fibers which are usually worn close to the skin; see W. Körner: Chemiefasern/Textilindustrie 29/81 (1979), pages 452 to 462 and 31/82 (1981), pages 112 to 116.

For obtaining a high water retention capacity (WR) of about 35% by weight in hydrophilic acrylic fibers with a core/sheath structure, it is necessary to use a relatively high proportion of non-solvent in the system of polyacrylonitrile/non-solvent/solvent, i.e. as a rule the PAN-solid/non-solvent ratio should not be more than about 1.3/1 for obtaining the high pore volume required for producing such a high water-retention capacity. High non-solvent contents, however, entail problems, inter alia in attempts to wash out the non-solvents as thoroughly as possible and stabilize the pores of the fibers.

When such hydrophilic, porous core/sheath fibers. are dyed, it must be remembered that the pore structure reinforces the light scattering on the fibers Dyed hydrophilic acrylic fibers having a water retention capacity of about 35% therefore have less depth of colour and brilliance due to the increased light scattering than a conventionally produced commercial acrylic fibers dyed with the same formulation (see D. Heinkes, Chemiefasern/Textilindustrie 36/88 (1986), pages 911–912.

Due to the high wearing comfort of textiles containing hydrophilic PAN fibers, they are used, as already mentioned, for sports and leisurewear clothing, especially of the kind worn close to the skin, and the textiles are often mixed, especially with cotton and wool. One particular problem of these textiles is the wet fastness of coloured articles; on account of the hydrophilic character of these textiles, they are worn close to the skin as perspiration absorbent garments and therefore frequently exposed to washing at 60° C. Under these washing conditions, which are more severe than those commonly used for acrylic fibers, the dye is liable to bleed from the acrylic fibers and stain accompanying fabrics and fibers such as wool, cotton, viscose, polyamide or polyester. This behaviour of fibres is hardly acceptable in practice.

It has now surprisingly been found that the PAN solids/ non-solvent ratio of about 1.3/1 hitherto required for obtaining a water retention capacity of about 30 to 60% in such hydrophilic core/sheath acrylic fibers can be very considerably shifted in favour of the PAN solids content (i.e. the non-solvent content may be reduced) without thereby lowering the water retention capacity to below 30% and without the usual unwanted staining of coloured articles under washing conditions at 60° C. if the hydrophilic fibers are subjected to a special after-treatment combination, in particular a highly intensive washing treatment with removal of the (non) solvents to reduce them to certain values, stretching in steam followed by fixing by a steam treatment and a mild, low tension drying of the fibers in the form of cut fibre flock (not fiber tows).

This for the first time enabled the PAN solids/non-solvent ratio to be raised to 3.25/1 without the water retention capacity thereby falling to below 30–35%. This resulted in considerable savings of cost in the manufacturing process, the use of smaller quantities of non-solvent, much more favourable (minimal) residual solvent contents in the hydrophilic fiber, substantially improved dye fastness (less bleeding) and a very stabilized pore volume in the hydrophilic fiber. Other advantages will be mentioned in the course of the description.

In spite of the fibers presumably having a smaller pore volume due to the reduction in the quantity of the non-solvent component which produces the pore structure, it is possible, by means of the more intensive washing out of the non-solvent component, stretching in steam and fixing of the pore volume with saturated steam followed by a mild, low tension drying of the cut fibers at only moderately high temperatures, (e.g. on a screen belt drier), to preserve the core volume in the fibers from the spinning process to the various after-treatment stages and beyond and to stabilize this pore volume and thus provide the means for moisture absorption, in other words to produce a high water retention capacity.

When the fibers are being dried under relatively mild conditions, they should be present in the form of flocks (cut fibers) or non-woven webs, i.e. as cut fibers, and not as folded, crimped spinning tows. It has been found that when the fibers are present in this flock form, a uniform sheet is obtained on the screen belt drier in the drying process and hence the fibers can be heated through and dried uniformly under mild conditions. If, on the other hand, the fibers are dried as crimped, folded, endless tows and placed on the drying surface in layers of the usual thickness employed for this process (e.g. 10 kg/m$^2$ of effective drying surface), differences in density and moisture (so-called moisture nests) frequently occur between the outer and inner layers of the tows As a result, non-porous, glossy tow sections are obtained side by side with porous, matted tow portions due to uneven heating and mass distribution on the (screen belt) drier (see Example 3). If, instead of the fibers being applied in thick layers (e.g. 1.26 kg/m$^2$ of effective drier surface in Example 3) the fibers are spread more thinly (e.g. up to 0.6 kg/m$^2$) and pass through the drier under mild conditions, these differences in the quality of the fibers can be greatly reduced or even removed. Such low covering densities, however, entail a high consumption of energy and are undesirable for economical reasons and generally unacceptable.

For obtaining the hydrophilic, porous polyacrylonitrile threads with a core/sheath structure according to the invention which are spun with smaller quantities of non-solvent, the conditions of the process had to be revised/limited as described above so that the (primary) pore structure obtained would not collapse or be impaired in the after-treatment stage following the dry spinning process. At no stage of the after-treatment process (except in the steam crimp and its crimp region) may a treatment temperature above 125° C. be employed in steam, and the temperature is preferably not above 109° C. in steam.

It has been found particularly advantageous to integrate the after-treatment of such hydrophilic acrylic fibres having a core/sheath structure with a continuous spinning and after-treatment process such as that first described, for example, in EP 119 521 for non-hydrophilic PAN threads, but even here, modifications have become necessary.

Compared with previously disclosed processes, very much higher water retention capacity values are obtained according to the invention for the same proportions of non-solvent. This means that for the technically important range of WR=30 to 60%, preferably 33 to 40%, only a very much smaller proportion of non-solvent is required. This means that the primary pore structures obtained after spinning can be much more easily stabilized in the course of the after-treatment stages and the amount of solvent and non-solvent still present in the threads is less by a factor of 3 to 5 (or more) after the first intensive washing stage than in the previously known processes and amounts to less than 2% by weight, preferably less than 1% by weight.

One unexpected result was the cross-sectional form of the threads obtained by the new process. The cross-section of the threads has become much more uniform and substantially oval (see FIG. 1 corresponding to Example 1) as compared with the much more non-uniform, ill defined, partly collapsed thread cross-sections obtained by the previous process (see Example 2, FIG. 2). These more uniform, rounder cross-sectional shapes also have their effect in yarns and textile webs produced from the fibers in that these products have a much improved, softer handle (as well as improved fastness properties) whereas the threads obtained by the processes hitherto known in the art were "rougher" and gave rise to more "scratchy" yarns.

The fibers obtained by the process according to the invention resemble the fibers known in the art in having a core/sheath structure with a porous inner core (see FIGS. 3 and 4).

The new procedure according to the invention has not only enabled the manufacturing costs to be considerably reduced on account of the much reduced non-solvent content but has also markedly improved the wet fastness of the hydrophilic core/sheath acrylic fibers.

SUMMARY OF THE INVENTION

This invention relates to processes for the production of hydrophilic threads or fibers of acrylonitrile homo- or co-polymers having a core/sheath structure with a sheath which is denser than the core and having a water retention capacity of at least 30% by weight, e.g. from 30 to 60, preferably from 30 to 50% by weight, most preferably from 33 to 46% by weight, and improved dye fastness properties as well as more uniform thread cross-sections, by spinning polyacrylonitrile solutions with highly polar spinning solvents and non-solvent liquids which boil at a temperature higher by 50 degrees Centigrade or more than the boiling point of the spinning solvent and which are readily miscible with the spinning solvent and with water and constitute non-solvents for the polymer which is to be spun, said spinning solution being spun in a hot air shaft, washed, stretched, crimped, dressed, steam treated, cut and dried, characterised in that a) the non-solvent liquid is added in a ratio of PAN solid to non-solvent liquid of from 3.25/1 to 1.7/1, preferably from 3.0/1 to 2.0/1, dry spinning is then carried out and the spinning sliver obtained is then made up into a tow, optionally after combining it with several slivers from individual shafts, b) the tow is subjected to intensive washing by counterflow in several stages under a shower spray so that residues of non-solvent and spinning solvent for polyacrylonitrile are reduced to less than 2% by weight, preferably less than 1% by weight, based on the solids content, c) the tow is stretched in saturated steam, optionally in several stages, crimped by the action of steam under pressure from a blast nozzle and treated with a dressing and d) the stretched, crimped and dressed tow is folded up and carried at a low tension through a fixing apparatus where it is treated with saturated steam and e) the steam treated tow is transferred to a cutting apparatus and f) the cut flock (cut fiber) material is then dried at low tension with air at a temperature from 50° to 125° C., preferably from 80° to 109° C., preferably until the moisture content is reduced to <3%.

BRIEF DESCRIPTION OF THE DRAWINGS

The figures are photographs of cross-sections of hydrophilic core/sheath acrylic fibres having a titre of about 1.1 dtex.

FIG. 1 shows fibres produced by the process according to the invention (Example 1). They are distinguished by their relatively uniform, substantially oval cross sections (Magnification 500).

FIG. 2 shows prior art fibers (see Example 2/Comparison mainly with DE 25 54 124). These fibers have very irregular cross-sections due to partial collapse of the spun threads in the after-treatment (Magnification 500).

Both fibre cross-sections show a typical core/sheath structure with a porous inner core and permeable sheath FIG. 3 corresponds to FIG. 1-Magnification 7200

FIG. 4 corresponds to FIG. 2-Magnification 7200.

In dyed articles of hydrophilic acrylic fibers produced by the process according to the invention, staining due to bleeding of the dye, which plays an important part in practice, is greatly attenuated or even eliminated (see Examples).

Staining due to bleeding of the dye is assessed as follows in accordance with DIN 54 017 C1:

1 Part of textile consisting of 4 parts of a coloured, hydrophilic article and 1 part of a white, undyed accompanying fabric is treated with 6 parts of water and 5 g/l of a heavy duty detergent such as Dixan® or Persil® in a roller bath for 30 minutes at 60° C. The white, undyed accompanying fabric is used in the form of a multifibre strip consisting of equal parts of cotton, viscose, polyester, polyamide and wool.

The "staining" is then assessed in grades on the grey scale according to DIN 54 002. Fastness Grade 5 denotes a completely unstained white fabric with no colour difference. Fastness Grades 4-1 represent colour stages with increasing colour differences in CIELAB units as laid down in DIN 54 002. The colour difference found between stained and unstained accompanying fabric is compared with the contrast stages of the grey scale for assessing staining. The fastness grade is taken as that stage on the grey scale which corresponds to the difference between the stained and the unstained accompanying fabric. If this lies halfway between two stages on the scale, then intermediate grades are given.

The hydrophilic acrylic fibers according to the invention were in all cases treated with cationic dyes for trichromatic dyeing with a fibre saturation of at least 50% in the colours "Bordeaux Red" and "Marine Blue" and the fibres were then examined for staining. "Bordeaux Red dyeing" was carried out with a combination of the following dyes:

0.4% by weight of Astrazon Gold Yellow® GLE 200%, 2.0% by weight of Astrazon Red® BBL 200% and 0.04% by weight of Astrazon Blue® FGGL 300%.

"Marine Blue dyeing" was obtained by a combination of 0.48% by weight of Astrazon Gold Yellow® GLE 200%, 0.45% by weight of Astrazon Red® BBL 200% and 1.9% by weight of Astrazon Blue® FGGL 300%.

Dyeing was in each case carried out with a fiber saturation of at least 50% on 10 g of yarn consisting of 100% of hydrophilic acrylic fibers by dyeing the yarn in a bath at boiling point and at a pH of 5 for 60 minutes until the bath was exhausted. The yarn was then after-purified with 1 g/l of Blankit®-IN for 30 minutes at 60° C. and the washing test was carried out at 60° C. after an intermediate drying. Finally, the wet fastness was assessed by measuring the staining of the accompanying fabric on the grey scale according to DIN 54 002.

Water retention capacity was determined according to DIN regulation 53 814 (see Melliand Textilberichte 4 (1973), page 350).

The fiber samples were immersed for 2 hours in water containing 0.1% of wetting agent. The fibers were then centrifuged for 10 minutes at an acceleration of 10,000 m/sec$^2$ and the quantity of water retained in and between the fibres determined gravimetrically. To determine the dry weight, the fibers were dried to a constant moisture content at 105° C.

The water retention capacity (WR) in % by weight is as follows:

$$WR = \frac{m_f - m_{tr}}{m_{tr}} \times 100$$

$m_f$ = weight of moist fibers $m_{tr}$ = weight of dry fibers

The following Examples serve to illustrate the invention in more detail. Parts and percentages are based on weight unless otherwise indicated.

EXAMPLE 1

Continuous spinning and after-treatment process 587.5 Parts of DMF are mixed with 137.5 parts of tetra-ethylene glycol (TEG) with stirring in a tank. 275 Parts of an acrylonitrile copolymer (PAN) of 93.6% of acrylonitrile, 5.7% of methyl acrylate and 0.7% of sodium methallyl sulphonate having a K-value of 81 are then introduced. The suspension obtained has a PAN solid/non-solvent ratio of 2:1 and a solids concentration of 27.5%. The suspension is pumped by a gear wheel pump into a spinning tank equipped with stirrer. The suspension is then heated with steam at 4 bar in a double walled tube for 3 minutes. The spinning solution, which is at a temperature of 131° C. at the discharge end of the tube, is cooled to 90° C. after leaving the heating device and is filtered and transferred directly to a spinning installation of 60 spinning shafts. The spinning solution is dry spun from 540 aperture dies at a draw-off rate of 300 m/min. The shaft temperature is 170° C. and the air temperature is 220° C. The individual spinning slivers (from one shaft each) were brought together and the tow having a total titre of 100,800 dtex (without can coiler) was continuously after-treated, i.e. it was washed in a folded state in a washing apparatus comprising 20 washing stages in which it was sprayed with the wash water while carried on a support in the form of an oscillating channel (apparatus according to DE-A 33 08 657). The dwell time of the tow in the washing apparatus was about 3 minutes, the temperature of the wash water was about 90° C. and the quantity of fresh water used was 3.5 kg of water/kg of threads. The tow left the washing apparatus at the rate of 250 m/min and was found to have a very low residual solvent content, i.e. a DMF content of 0.7% and a tetraethylene glycol content of 0.9% by weight. After the washing process, the tow was stretched in saturated steam at about 100° C. in two stages. The stretching ratio was 1:1.3 in the first stage and 1:3.25 in the second stage and the tow was discharged at the rate of about 1050 m/min. After the tow had been stretched, it was crimped by means of saturated steam at 7 bar from a steam nozzle while a 10% by weight oil in water emulsion was added in a side stream from two bores by means of two gear wheel pumps in such quantities that 0.3% by weight of oil, based on the solids content of the fibers, was applied. After crimping, the crimped cake was steam treated in a steaming apparatus with the steam which was discharged from the crimping die and relieved of pressure. The dwell time in the steam atmosphere of about 100° C. was 60 seconds. The crimped tow, which still had a boiling shrinkage of about 3%, was then cut up into staple fibers 40 mm in length by means of a rotary cutter. The sheet of fibers was dried on a screen belt drier for 2 minutes at 120° C. under a low tension and the staple fibers were packaged in a bale press as the finished fibers.

The hydrophilic acrylic fibers produced as described above and having a final titre of 1.4 dtex have a water retention capacity of 55%, a tear resistance of 2.4 cN/dtex and an elongation at break of 27%.

The hydrophilic acrylic fibers, which have a pronounced core/sheath structure with only slightly irregular, in most cases oval to trilobate cross-sectional forms (see FIG. 1) can be carded at a rate of 100 m/min. The handle of the yarns obtained from the fibers according to the invention is distinctly less rough than that of yarns produced by earlier processes, e.g. according to DE-OS 25 54 124.

Some of the fibers were dyed in the colours Bordeaux Red and Marine Blue with a fiber saturation of >50% and then washed at 60° C. in the presence of undyed accompanying fabric.

The staining was assessed according to DIN 54 002 as follows:

TABLE 1

| Type of fabric | Fastness grading |
|---|---|
| Cotton | 4 |
| Viscose | 4–5 |
| Polyester | 5 |
| Polyamide | 3–4 |
| Polyacrylic | 5 |
| Wool | 4 |

EXAMPLE 2

Discontinuous spinning process Comparison according to the state of the art/mainly DE-OS 25 54 124.

Part of the tow having a total titre of 100 800 dtex was collected in a spinning can and then subjected to a conventional procedure. For this purpose, the tow was washed in water at 90° C. in washing vats (residual solvent contents: 7.5% TEG and 1.7% of DMF (based on PAN solids content)), stretched in boiling water in two stages, first 1:1.3-fold and then 1:3.25-fold (in the second stage) and dressed with antistatic dressing. The tow was then placed on a screen drum drier (permitting 20% shrinkage) in a layer of 1.26 kg/m$^2$ at 120° C. and crimped in a compression chamber and then cut up into fibers of 40 mm staple length.

The hydrophilic acrylic fibers produced as described above and having a final titre of 1.3 dtex have a water retention capacity of 27% (about half the value obtained in Example 1!), a tear resistance of 2.5 cN/dtex and an elongation at break of 24%. The hydrophilic fibers, which again have a pronounced core/sheath structure but very irregular cross-sectional forms (see FIG. 2) could be worked up on a card at the rate of 100 m/min.

A proportion of the fibers was again dyed in the colours Bordeaux Red and Marine Blue with a fibre saturation of >50% and washed at 60° C. in the presence of undyed accompanying articles and the staining of these articles was assessed according to DIN 54 002 as follows:

TABLE 2

| Type of fabric | Fastness grade |
|---|---|
| Cotton | 2–3 |

TABLE 2-continued

| Type of fabric | Fastness grade |
|---|---|
| Viscose | 3 |
| Polyester | 3–4 |
| Polyamide | 2–3 |
| Polyacrylic | 3–4 |
| Wool | 2–3 |

EXAMPLE 3

Continuous process (not according to the invention)

Part of the washed, stretched, crimped, dressed and steam treated tow having a total titre of 100 800 dtex was deposited as a folded, endless tow still having a boiling shrinkage of about 3% on a screen belt drier at a low tension and dried at 120° C. The dwell time in the drier was 2 minutes. The tow was drawn off at the rate of 650 m/min, cut up into staple fibers 40 mm in length on a rotary cutter and packaged into bales on a bale press. The density of the tow on the drier was about 1.26 kg/m$^2$.

The acrylic fibers produced as described above and having a final titre of 1.4 dtex are partly glossy and partly in a "matted" form. The glossy fibers have a water retention capacity of 9% and bizarre, irregular cross-sectional forms. The matted fibers have a water retention capacity of 54%, relatively uniform oval to trilobate cross-sections and a core/sheath structure.

If the procedure described above is carried out but the density of the layer of endless tow placed on the drier in the drying process is considerably reduced and care is taken to ensure thorough penetration of the heat through the tow during the drying process, the fibers obtained are predominantly matted but when layer densities of less than 0.6 kg/m$^2$ are employed, the process is technically very uneconomical and virtually impracticable.

EXAMPLES 4 to 6

(not according to the invention) and

EXAMPLES 6 to 17

(Process A according to the invention, Process B not according to the invention)

The following Table shows further examples of hydrophilic acrylic fibers with different PAN solids/non-solvent ratios for the process of production according to the invention by comparison with a process employing a conventional after-treatment. The same acrylonitrile copolymer (according to Example 1) was used in all cases. The spinning and after-treatment conditions were carried out both according to the invention as described in Example 1 (Procedure A) and by the conventional process as described in Example 2 (Procedure B). The hydrophilic acrylic fibers were again subjected to a trichromatic dyeing in the colours Bordeaux Red and Marine Blue with a fiber saturation of >50% and staining of undyed accompanying fabrics after washing at 60° C. was assessed according to DIN 54 002.

It may be seen from the Table that hydrophilic acrylic fibers having a WR of at least 30% and markedly improved dye fastnesses after washing at 60° C. compared with fibers treated by the conventional after-treatment (Procedure B, not according to the invention) may be obtained up to a PAN-solids/non-solvent ratio of 3/25 and employing Procedure A (according to the invention).

| No. | PAN % | TEG % | PAN/non-solvent ratio | Type of after-treatment | WR % | Grading of staining of Cotton, | Viscose, | Polyester, | Polyamide, | Polyacrylic, | wool |
|---|---|---|---|---|---|---|---|---|---|---|---|
| 4 | 22.5 | 17.5 | 1.3/1 | A | 78 | 2–3 | 3–4 | 4 | 2–3 | 3–4 | 2–3 |
| 5 | 22.5 | 17.5 | not according to the invention | B | 36 | 2 | 2–3 | 3–4 | 2 | 3 | 2–3 |
| 6 | 25.0 | 15.0 | 1.7/1 | A | 65 | 3 | 3–4 | 4–5 | 3 | 4 | 3 |
| 7 | 25.0 | 15.0 | 1.7/1 | B | 29 | 2–3 | 3 | 4 | 2–3 | 3 | 2–3 |
| 8 | 27.5 | 12.5 | 2.2/1 | A | 55 | 3–4 | 4 | 4–5 | 3–4 | 5 | 4 |
| 9 | 27.5 | 12.5 | 2.2/1 | B | 26 | 2–3 | 3 | 4 | 2–3 | 3–4 | 3 |
| 10 | 27.5 | 11.0 | 2.5/1 | A | 46 | 3–4 | 4 | 4–5 | 3–4 | 4 | 3–4 |
| 11 | 27.5 | 11.0 | 25/1 | B | 23 | 3 | 3–4 | 4 | 2–3 | 4 | 3 |
| 12 | 27.5 | 10.0 | 2.75/1 | A | 43 | 4 | 4–5 | 4–5 | 4 | 4–5 | 4 |
| 13 | 27.5 | 10.0 | 2.75/1 | B | 20 | 3 | 3–4 | 4 | 3 | 4 | 3 |
| 14 | 30 | 10.0 | 3.0/1 | A | 36 | 4–5 | 4–5 | 5 | 4–5 | 5 | 4–5 |
| 15 | 30 | 10.0 | 3.0/1 | B | 16 | 3–4 | 4 | 4–5 | 3–4 | 4–5 | 3–4 |
| 16 | 32.5 | 10.0 | 3.25/1 | A | 30 | 4–5 | 4–5 | 5 | 4–5 | 5 | 4–5 |
| 17 | 32.5 | 10.0 | 3.25/1 | B | 13 | 4 | 4 | 4–5 | 3–4 | 4–5 | 4 |

A = Type of after-treatment as described in Example 1 (according to the invention)
B = Type of after-treatment as described in Example 2 (Comparison, not according to the invention)

What is claimed is:

1. Process for the production of hydrophilic fibers of acrylonitrile homo- or copolymers having core/sheath structures with a denser sheath than the core, a water retention capacity of at least 30% by weight, improved dye fastness, and uniform cross-sections, by spinning polyacrylonitrile solutions into hot air shafts, said solutions containing highly polar spinning solvents and non-solvents liquids which have a boiling point higher by 50° C. or more than the boiling point of the spinning solvent used and which are readily miscible with the spinning solvent and with water and are non-solvents for the polymer to be spun wherein a) the non-solvent liquid is added in a ratio of PAN-solids to non-solvent liquid of from 3.25/1 to 1.7/1, dry spinning is carried out to form slivers that are then formed into a tow by joining several slivers from the hot air shafts together, b) the tow is subjected to intensive washing on the counterflow principle in several stages with sprinkling of the tow so that the residual non-solvent and spinning solvent contents for polyacrylonitrile are removed down to a residue of less than 2% by weight based on a solids content, c) the tow is stretched in saturated steam, in one or several stages, crimped by steam under pressure in a blast nozzle and treated with a dressing, and d) the stretched, crimped and dressed tow is transported as a folded tow at low tension through a fixing apparatus where it is subjected to saturated steam.

e) the steam treated tow thus obtained is to a cutting device and f) the resulting cut material is then dried at low tension with hot air at 50° to 125° C. to a moisture content of less than 3%.

2. Process according to claim 1, where the water retention capacity of the threads or fibers is from 30–60% by weight.

3. Process according to claim 1, where in stage b) the spinning solvents contents are removed down to less than 1% by weight.

4. Process according to claim 1, wherein in the process stage f) the cut material is dried with hot air of 80° to 109° C. to a moisture content less than 3%.

5. Process according to claim 1, wherein the material obtained from the dry spinning process is introduced into the following after-treatment stages without interruption of the process between spinning and after-treatment.

6. Process according to claim 1 wherein the ratio of PAN-solids to non-solvent liquid is 3.0/1 to 2.0/1.

7. Process according to claim 1 wherein the cut material is dried with hot air at 80° to 109° C.

* * * * *